US005102060A

United States Patent [19]

Busenhart

[11] Patent Number: 5,102,060

[45] Date of Patent: Apr. 7, 1992

[54] THREAD WINDING MACHINE WITH SWINGABLE THREAD CHANGE MECHANISM

[75] Inventor: Peter Busenhart, Winterthur, Switzerland

[73] Assignee: Maschinenfabrik Rieter AG, Winterthur, Switzerland

[21] Appl. No.: 555,609

[22] Filed: Jul. 23, 1990

[30] Foreign Application Priority Data

Jul. 24, 1989 [CH] Switzerland ..... 2756/89

[51] Int. Cl.[5] ..... B65H 67/048

[52] U.S. Cl. ..... 242/18 A; 242/18 PW; 242/35.5 R

[58] Field of Search ..... 242/18 A, 18 PW, 35.5 R, 242/35.5 A

[56] References Cited

U.S. PATENT DOCUMENTS

| | | | |
|---|---|---|---|
| 3,109,602 | 11/1963 | Smith | 242/18 A |
| 3,310,247 | 3/1967 | Emery | 242/18 A |
| 3,717,310 | 2/1973 | Ritter | 242/18 A |
| 4,136,834 | 1/1979 | Tschentscher | 242/18 PW |
| 4,155,512 | 5/1979 | Bauch et al. | 242/18 R |
| 4,465,242 | 8/1984 | Ari et al. | 242/18 PW |
| 4,477,032 | 10/1984 | Pfyffer et al. | 242/18 PW |
| 4,638,955 | 11/1987 | Schippers et al. | 242/18 PW |
| 4,646,981 | 3/1987 | Ohayon | 242/18 PW |
| 4,657,205 | 4/1987 | Sugroka | 242/18 PW |
| 4,784,342 | 11/1988 | Matthies | 242/18 PW |
| 4,928,475 | 5/1990 | Matsui et al. | 242/18 PW |
| 4,969,607 | 11/1990 | Busenhart et al. | 242/18 A |

*Primary Examiner*—Stanley N. Gilreath
*Attorney, Agent, or Firm*—Burns, Doane, Swecker & Mathis

[57] ABSTRACT

A winding machine winds threads upon a package. The machine includes a thread change mechanism for positioning the threads relative to the package. The thread change mechanism includes a thread guide member having first and second longitudinally spaced ends. The guide member is mounted for swinging movement relative to a housing of the machine by means of two swingable levers. One end of each lever is attached adjacent the first end of the thread guide member. A servo-motor is operably connected to one of the levers for swinging the thread guide member. A power transmission operably interconnects the first and second ends of the guide member for positively transmitting a swinging motion of the first end to the second end in order to effect synchronous swinging movement of the first and second ends. A limiting device retains the guide member in a thread change position but allows the guide member to be moved past the thread change position to a thread drawing-in position.

19 Claims, 13 Drawing Sheets

Fig. 15
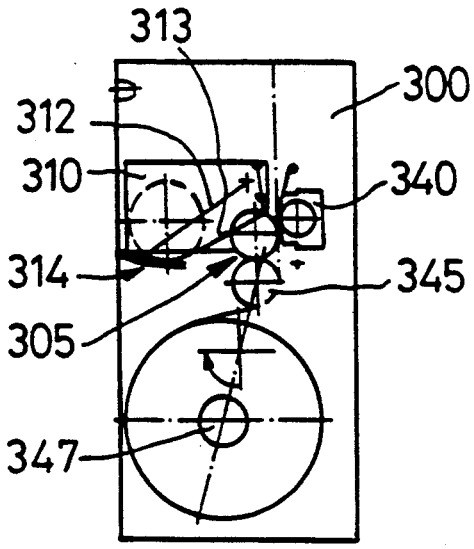
Fig. 16
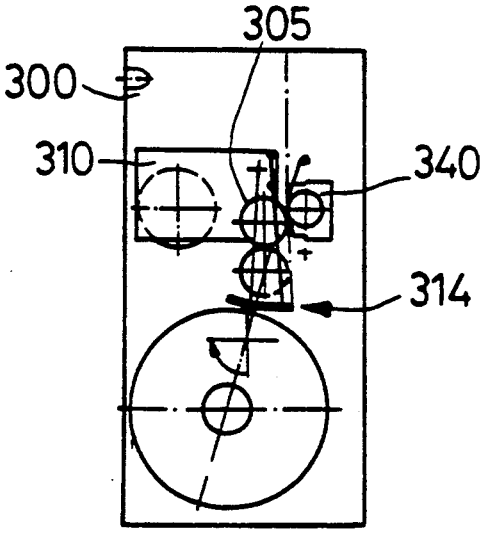
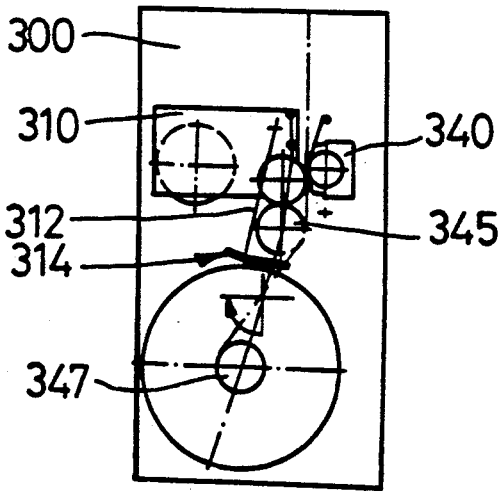
Fig.17

THREAD WINDING MACHINE WITH SWINGABLE THREAD CHANGE MECHANISM

BACKGROUND OF THE INVENTION

The invention relates to a thread changing system for thread winding machines of the type in which a thread change mechanism is provided for positioning the threads relative to a package on which the threads are to be wound.

Winding machines with at least two winding mandrels are known, whereby one mandrel of which is held in a position of readiness, while the material is wound on at least one other mandrel. As soon as the package on the first mandrel is full, the second mandrel is moved from the position of readiness into a winding position whereby the material to be wound must be transferred from one package to the other. Such winding machines are well known. They normally contain a so-called revolver, which carries the mandrel with the package.

The winding machine can also be provided with a thread changing device and with a thread drawing-in device operating in conjunction with this thread changing device. The ends of a thread guide member of the thread changing device are carried by the ends of rotatable parallel carrier levers, with one of the carrier levers actuated by a servo-motor.

A known thread changing system of this type, disclosed in U.S. Pat. No. 4,136,834, has a thread changing device which includes a thread guide member, both ends of which are supported by carrier levers that swing about a common axis. One of the carrier levers is driven by a linear servo-motor. A disadvantage of the known thread changing device exists in that the driven end of the guide member is not vibration free. A further disadvantage exists with regard to the long length of the guide member (especially in the case of multi-package winding machines) in that the movements of the two ends of the guide member may not be synchronized. Further, the guide member includes a plurality of axially movable thread guides and a thread drawing-in device by which the axial movements of the thread guides are effected by means of a screw spindle driven by an electric motor. A disadvantage exists due to the high weight of the thread guide member and because the driving motor occupies considerable space and requires flexible electrical leads, which are susceptible to disturbances.

The invention involves the development of a thread changing system of the previously described type wherein the thread guide member is vibration free and its two ends move in synchronism.

The invention further involves producing a thread change system with a thread drawing-in apparatus which has low weight and the drive of which occupies only a small amount of space.

SUMMARY OF THE INVENTION

The present invention relates to a winding machine for winding a thread upon a package, wherein a thread change mechanism is provided for positioning at least one thread relative to the package. The thread change mechanism includes a thread guide member having first and second longitudinally spaced ends. The thread guide member is mounted for swinging movement relative to a housing of the machine by means of a mechanism including two swingable levers. One end of each lever is attached adjacent the first end of the thread guide member. A servo-motor is operably connected to one of the levers for swinging the thread guide member to a thread changing position. A power transmission mechanism operably interconnects the first and second ends of the thread guide member for positively transmitting a swinging motion of the first end to the second end to effect synchronous swinging movement of the first and second ends.

The servo-motor moves the thread guide member between three positions which define a rest position, a thread changing position, and a thread drawing-in position. The thread guide member is arranged to move through and beyond the thread changing position in order to reach the thread drawing-in position.

BRIEF DESCRIPTION OF THE DRAWINGS

The embodiment of the invention is described in the following with the aid of the drawings, wherein.

Figure 10:
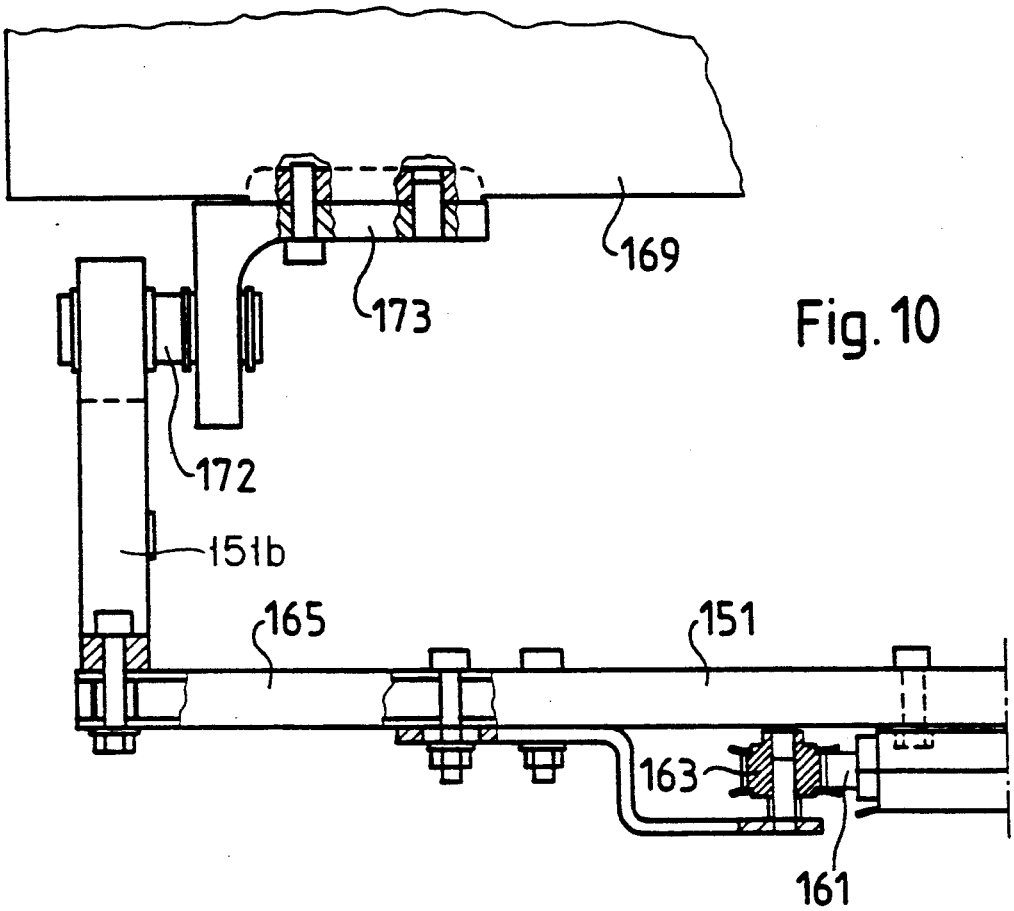
Figure 12:
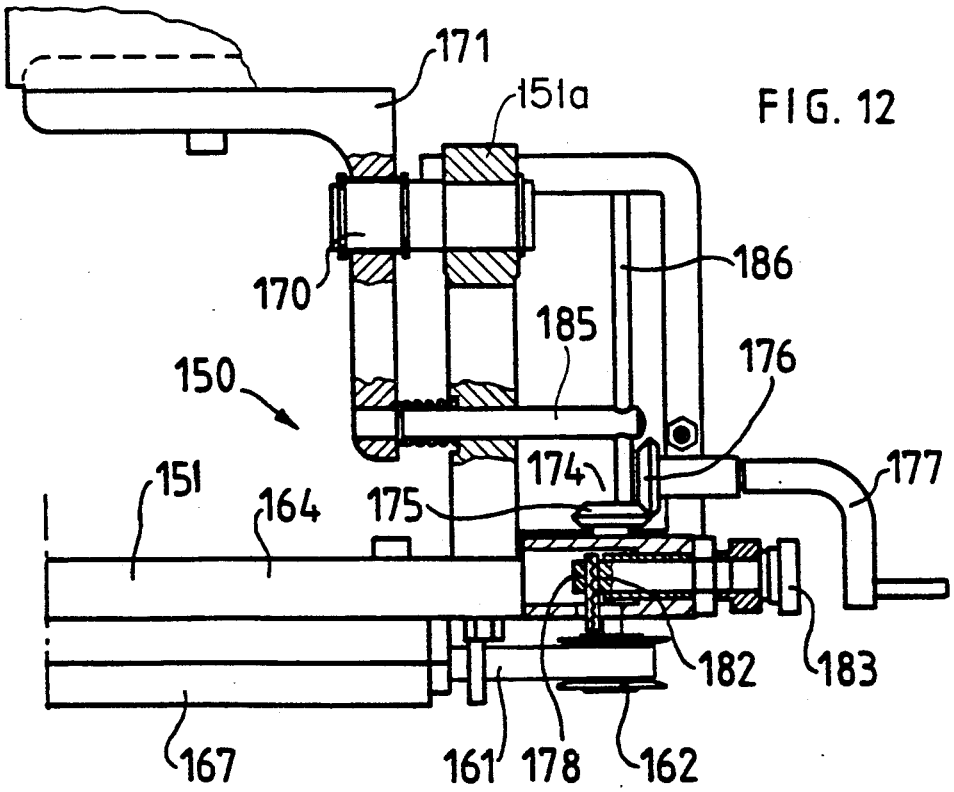
Figure 11:
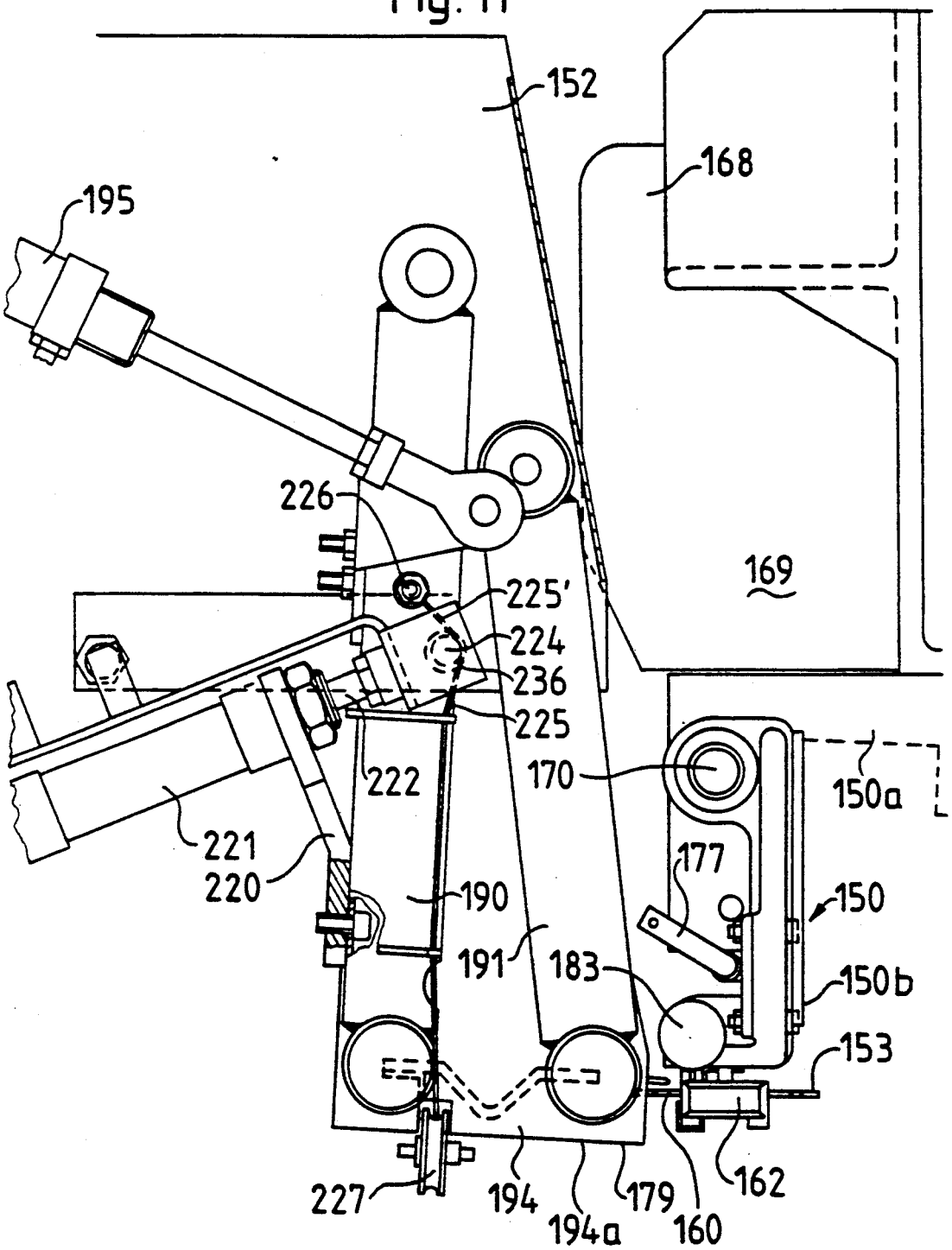
Figure 13:
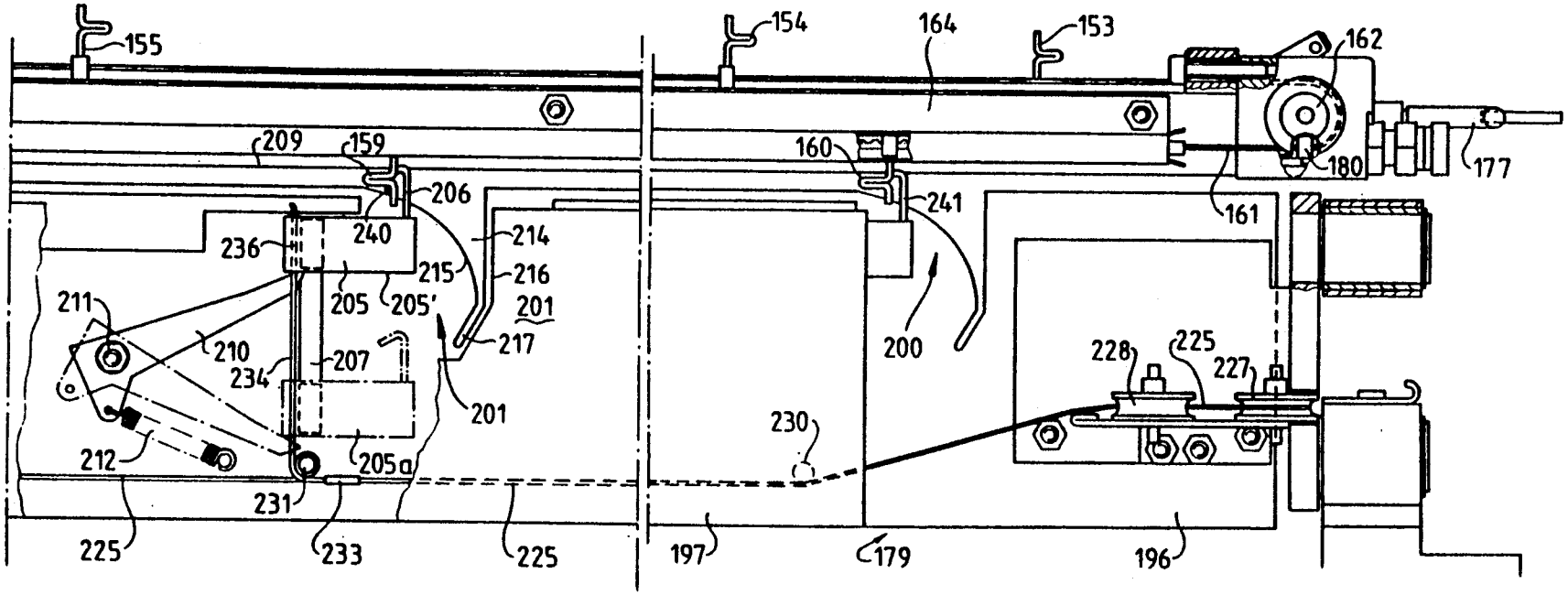
Figure 14:
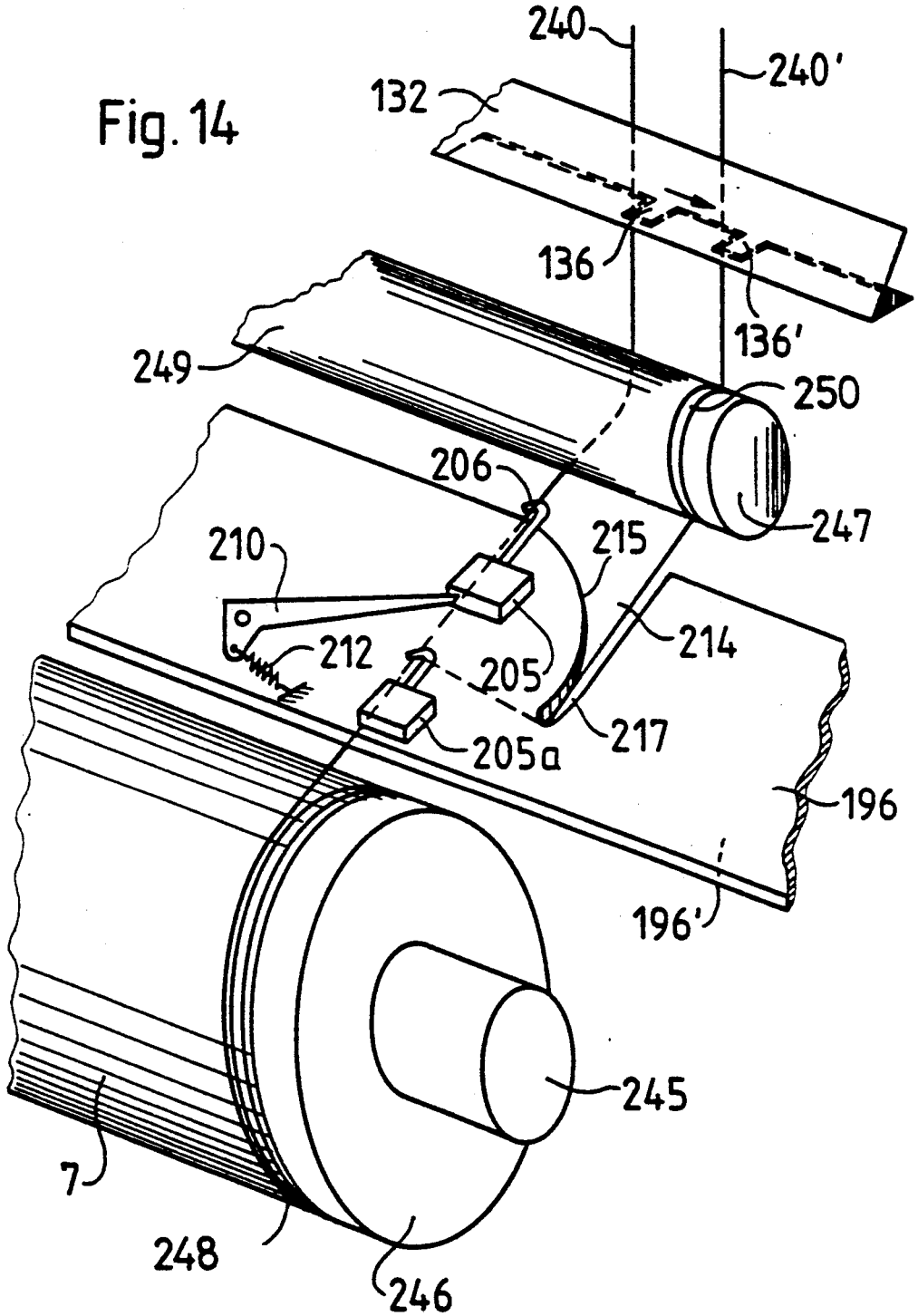
Figure 18:
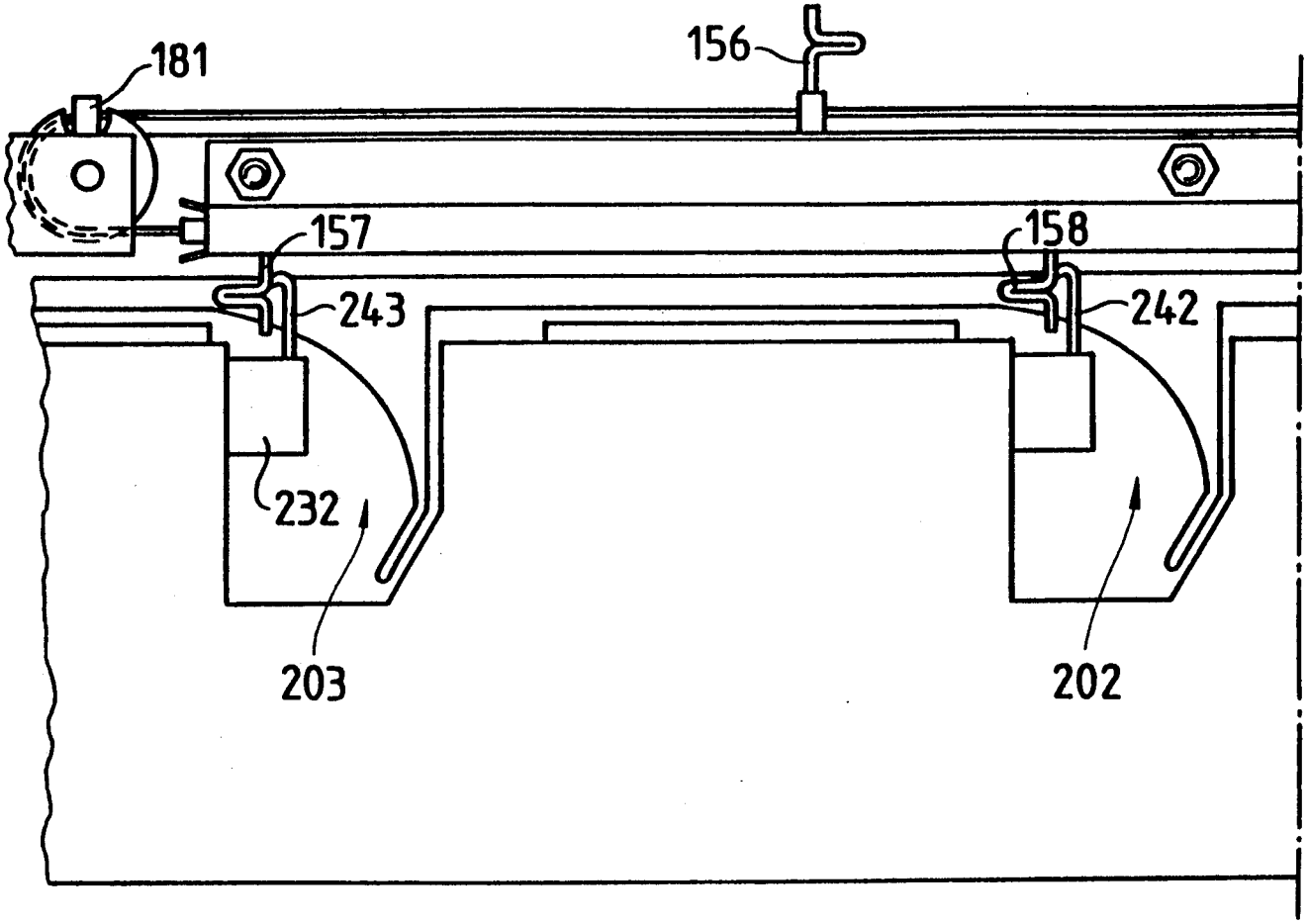

FIGS. *9a–9c* are schematic representations in side elevation of the movement phases of a rocker arm lever according to the invention;

FIG. 10 is an elevational view of one end portion of a second embodiment of a thread drawing-in device according to the invention;

FIG. 11 is a side elevational view of a second embodiment of a thread changing device in association with the thread drawing-in device depicted in FIG. 10; the thread guide member is shown in the swung out operating position;

FIG. 12 is an elevational view of an end of the thread drawing-in device which is opposite the end thereof depicted in FIG. 10;

FIG. 13 is a top plan view of a section of the second embodiment of the thread guide member of FIG. 11 with the top cover removed;

FIG. 14 is a schematic perspective view of portions of the thread guide device and thread drawing-in device depicted in FIG. 11;

FIGS. 15–17 are schematic side elevational views of the winding system according to the present invention in various operating conditions; and FIG. 18 is a continuation of the views of FIG. 13, depicting another portion of the thread guide device.

DETAILED DESCRIPTION OF PREFERRED EMBODIMENTS OF THE INVENTION

A thread guide member is hereinafter designated as a change sheet, without implying therewith that a sheet metal version of this member is of essential importance. That is, the guide member can be of any suitable configuration.

Figure 1:
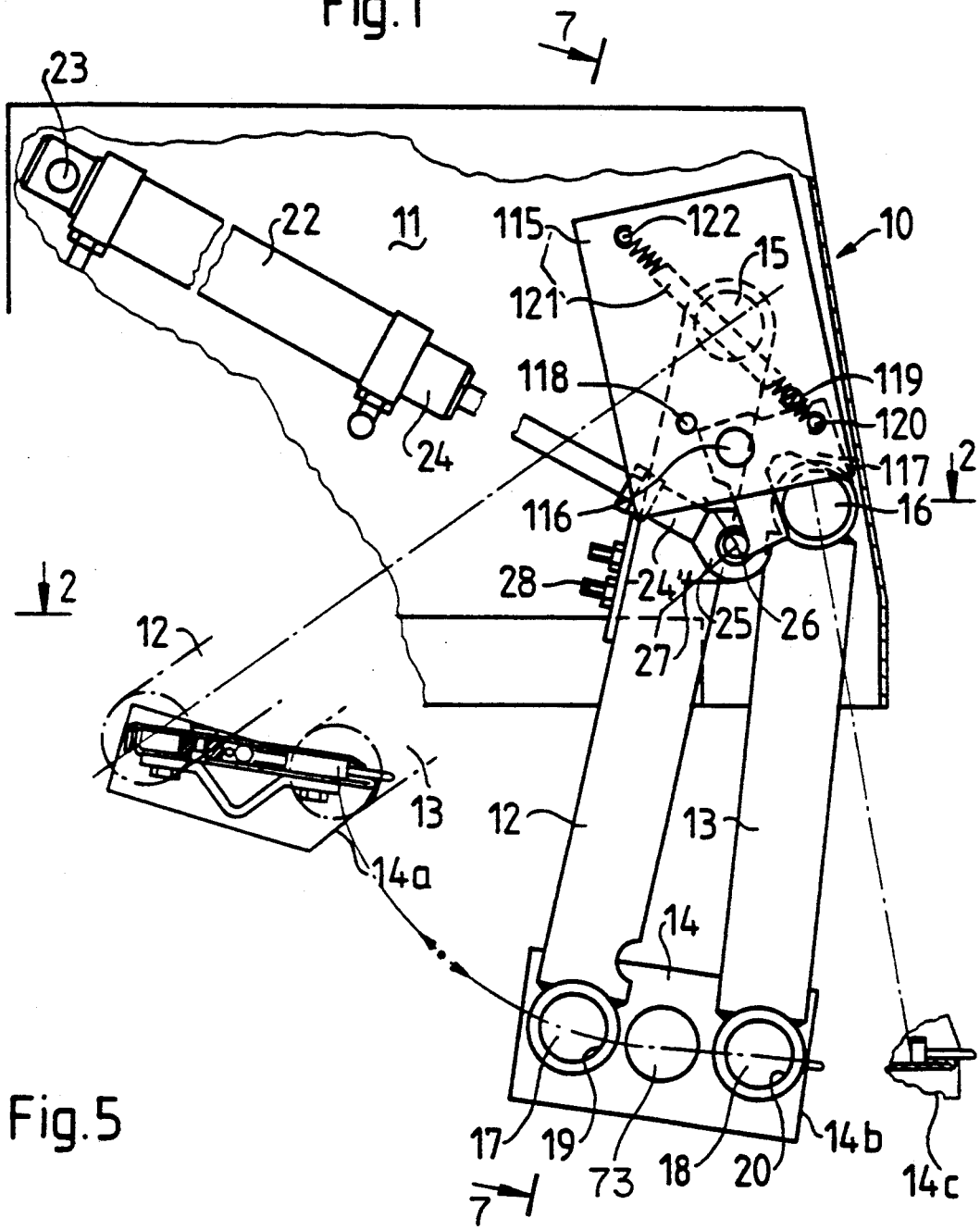
FIG. 1 is a side elevational view (of a side facing away from the machine casing) of a sliding carriage of a winding machine according to the invention; a side wall of the carriage is broken away and a thread guide member is represented in a swung out operating position in solid lines and in a rest position in broken lines.

According to FIG. 1, a sliding carriage 10 of a thread winding machine (not further shown) carries a thread guide member or change sheet 14 supported at its axial front end by means of two pivoting carrying levers 12 and 13 mounted on a free side wall 11 of the carriage. The carrying lever 12 pivots on a pin 15, and the carrying lever 13 pivots on a pin 16 mounted on the side wall 11. Through such a double suspension of the change sheet 14, the stability of this axial front end during the swiveling movement is considerably greater than if it were supported by only a single suspension. The change sheet 14 is provided with two pins 17 and 18, which respectively pivot in holes 19, 20 of the two carrying levers 12, 13. One end of a linear servo-motor 22 swivels on a pin 23 mounted on the side wall 11. The free end 24' of a piston rod 24 of the servo-motor is provided with a ball and socket joint 25, the joint pin 26 of which is fastened on a bracket 27, which in turn is fastened to the carrying lever 12 by means of screws 28 (see FIG. 2). The servo-motor 22 controls the swiveling movement of the change sheet 14 between three distinct positions, namely a starting or rest position indicated as 14*a*, a thread change or thread catching position indicated as 14*b*, and a thread drawing-in or lacing-up position 14*c*.

In order to maintain the above-mentioned stability of the change sheet 14 across its whole axial length, it is also supported from the sliding carriage 10 on its other or axial rear end 30 (which faces towards the machine casing). In addition, the change sheet 14 is provided with a pin 31 (FIG. 6) on this rear end, which is pivoted in the free end of a curved carrying lever 33, (FIG. 4). Furthermore, in order to ensure synchronized movement of both ends of the change sheet 14, which occupies a considerable length on a winding machine having a plurality of packages per mandrel, the swiveling movement of the two carrying levers 12 and 13 is transmitted in synchronism with the movement of the carrying lever 33. This is achieved as follows, by means of two power transmission mechanisms 34 (FIG. 3) and 35 (FIG. 4).

At the front end 40 of the change sheet 14, one end 41 of a lever 42 is pivoted on a smaller diameter part of the pin 17 of the change sheet 14. The other end of the lever 42 is pivotably fastened by a pin 44 to one side 45 of a freely pivoting gear wheel 46. An opposite side of the gear wheel 46 is pivoted to the inside of the free side wall 11 of the sliding carriage 10. The lever 42 is thus free to move within a plane which is axially spaced from the pivot pin of the gear wheel. The lever 42 is slidably guided for free linear sliding movement in a hole 47 formed in a disc 48 which is freely pivotally mounted on the side wall 11. Thus, the lever 42 can also pivot with the disc 48. The gear wheel 46 constitutes a pinion of a belt drive 50 that includes a toothed belt 51 and a driven gear wheel 52. The driven gear wheel 52 is fastened on a connecting shaft 53 (FIG. 2) which extends in the longitudinal direction through the sliding carriage 10 up to an opposite side wall 54 (FIG. 4) that faces the machine casing. There, a second gear wheel 55 is fastened on the shaft 53. This gear wheel 55 constitutes a pinion for a belt drive 56 which includes a toothed belt 57 and a driven gear wheel 58. One side of the wheel is pivotally mounted to the wall 54. One end of the carrying lever 33 is pivoted on the other side of the gear wheel 58 by means of a peg 60. Similarly to the lever 42, the carrying lever 33 is slidably guided for free linear sliding movement in a hole 61 formed in a disc 62 which is freely pivotally mounted on the side wall 54. The other end 63 of the carrying lever 33 is swiveled on the pin 31 of the change sheet 14. The drive transmission operates as follows by means of the two power transmission mechanisms 34 and 35.

Figure 3:
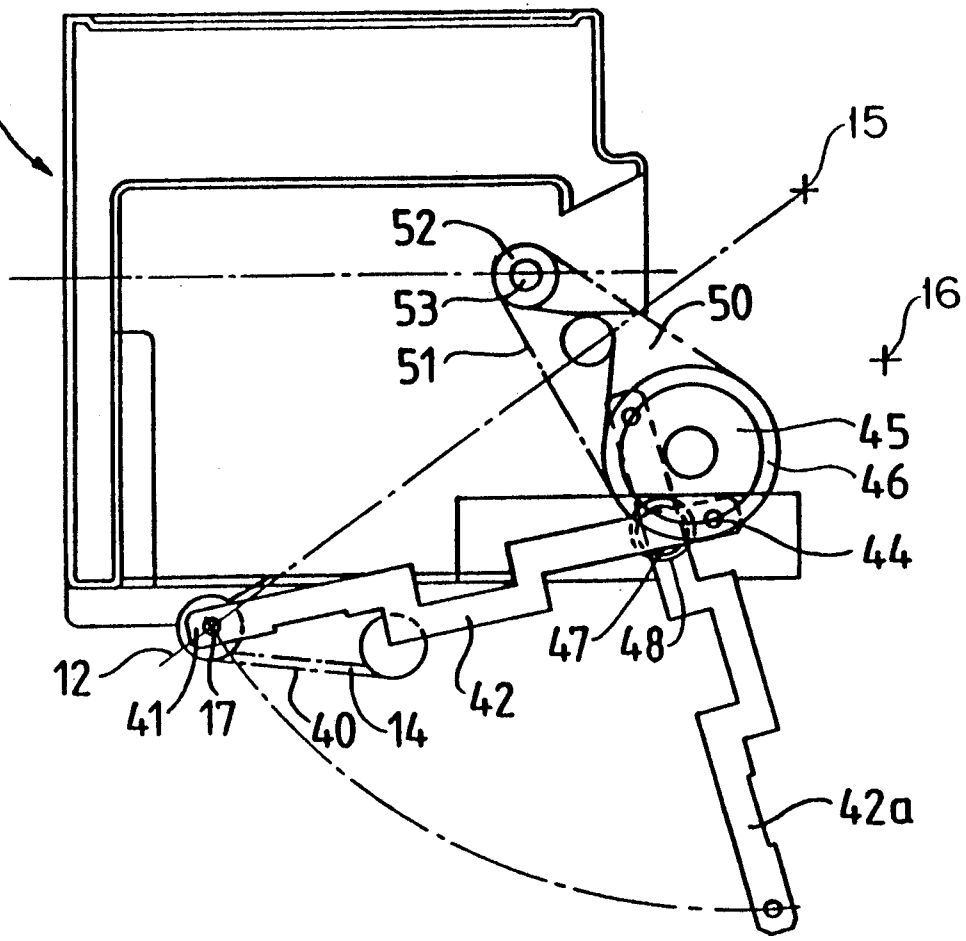
FIG. 3 is a side elevational view of a portion of a power transmitting mechanism according to the invention which is driven by movement of the thread guide member.
Figure 4:
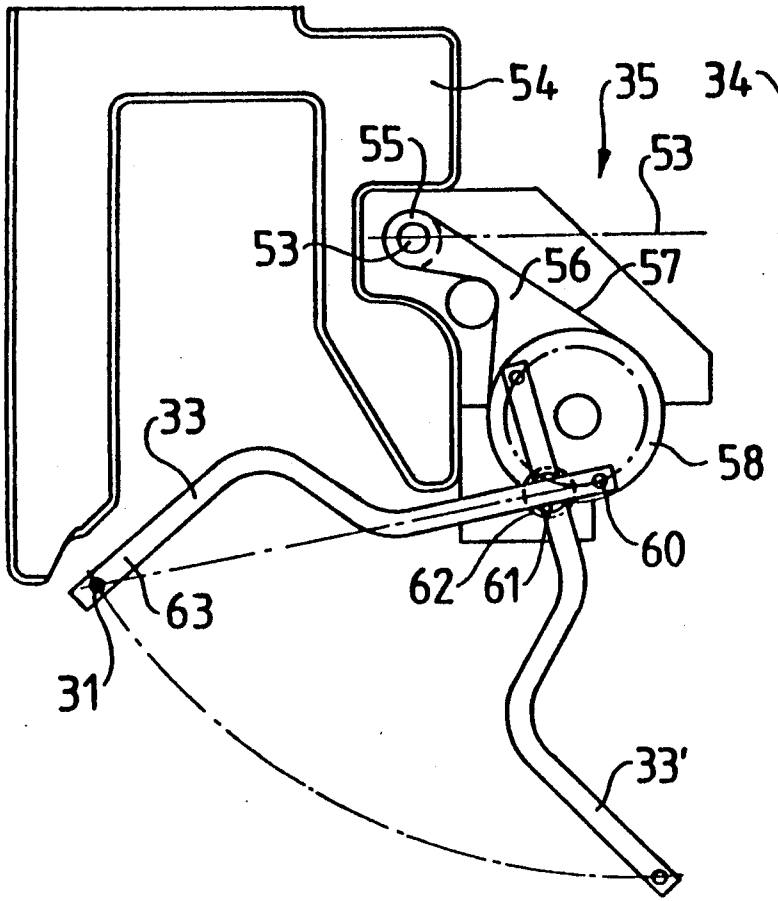
FIG. 4 is a side elevational view of another portion of the power transmitting mechanism which is driven by the first portion thereof.

Simultaneously with the swiveling movement of the change sheet 14 on the carrying levers 12 and 13 from the starting position 14*a* (FIG. 1) into the thread change position 14*b*, the lever 42 is turned counterclockwise into the position 42*a* (FIG. 3). In so doing, the lever 42 is displaced by the change sheet 14 and rotates the gear wheel 46 which, in turn, rotates the connection shaft 53 via the belt drive 50. Thus, the gear wheel 55 of the belt drive 56 of the transmission mechanism 35 is likewise rotated counterclockwise. The gear wheel 55 of this belt drive 56 drives the gear wheel 58 and the latter turns the carrying lever 33 counterclockwise. Thus, the lever 33 transmits to the rear end of the change sheet the same swiveling motion effected to the front end thereof by the carrying levers 12 and 13. Since the transmission ratio of the two belt drives 50 and 56 is the same, the swiveling motion of the carrying lever 33 is substantially synchronous with the swiveling motion of the carrying levers 12 and 13 on the front of the sliding carriage. Accordingly, it is ensured that the swiveling motion of the rear end 30 of the change sheet 14 will not lag the swiveling motion of the front end 40.

Figure 5:
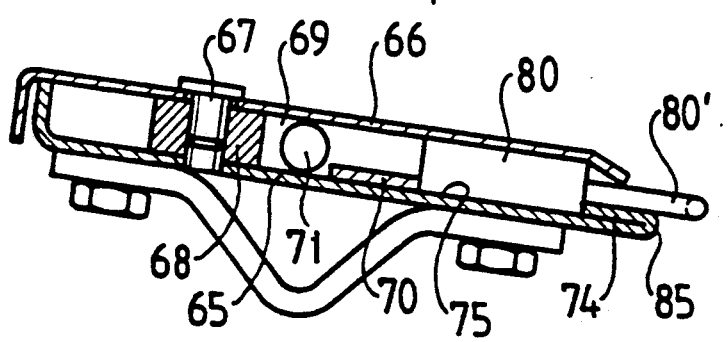
FIG. 5 is a longitudinal cross section taken along line 5—5 in FIG. 6.
Figure 6:
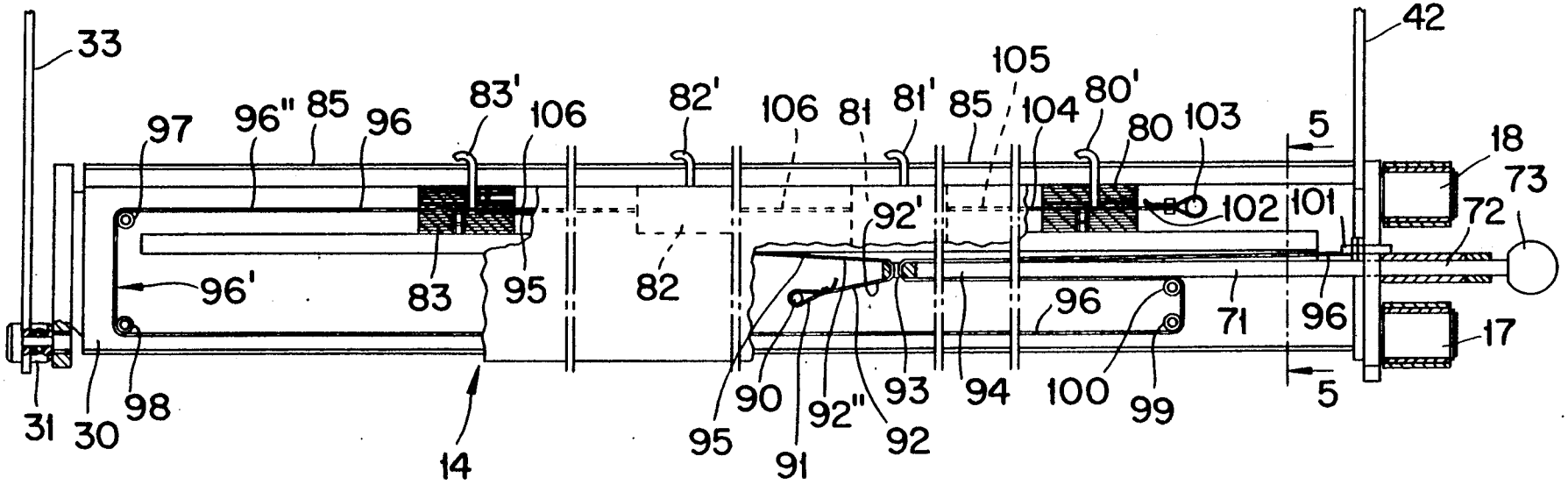
FIG. 6 is a top view of the thread guide member with a cover plate thereof removed.

The change sheet 14 itself comprises a base plate 65 (FIG. 5) and a cover plate 66, which is fastened in spaced relation with the base plate by means of a clearance rod 68 and screws 67, so that the change sheet 14 has a hollow space 69 in the longitudinal direction. A strip 70 on the base plate 65 forms, together with the clearance rod 68, a guide for a drawing-in rod 71 (FIG. 6). One end 72 of the rod 71 projects from the change sheet 14 and is provided with a knob 3. The base plate 65 has a folded under edge 74 which forms a guide 75 under the cover plate 66 for four sliders 80, 81, 82, 83, each provided with a hook-like thread guide element 80', 81', 82' and 83' which projects from a leading side 85 of the change sheet 14. As many sliders are provided as there are winding positions on the winding machine. One end 91 of a cable 92 is fastened to a pin 90 (FIG. 6) fixed to the base plate 65. The cable 92 runs through a hole 93 in the free end 94 of the drawing-in rod 71 and includes a section 93 connected to the rear slider 83.

Figure 7:
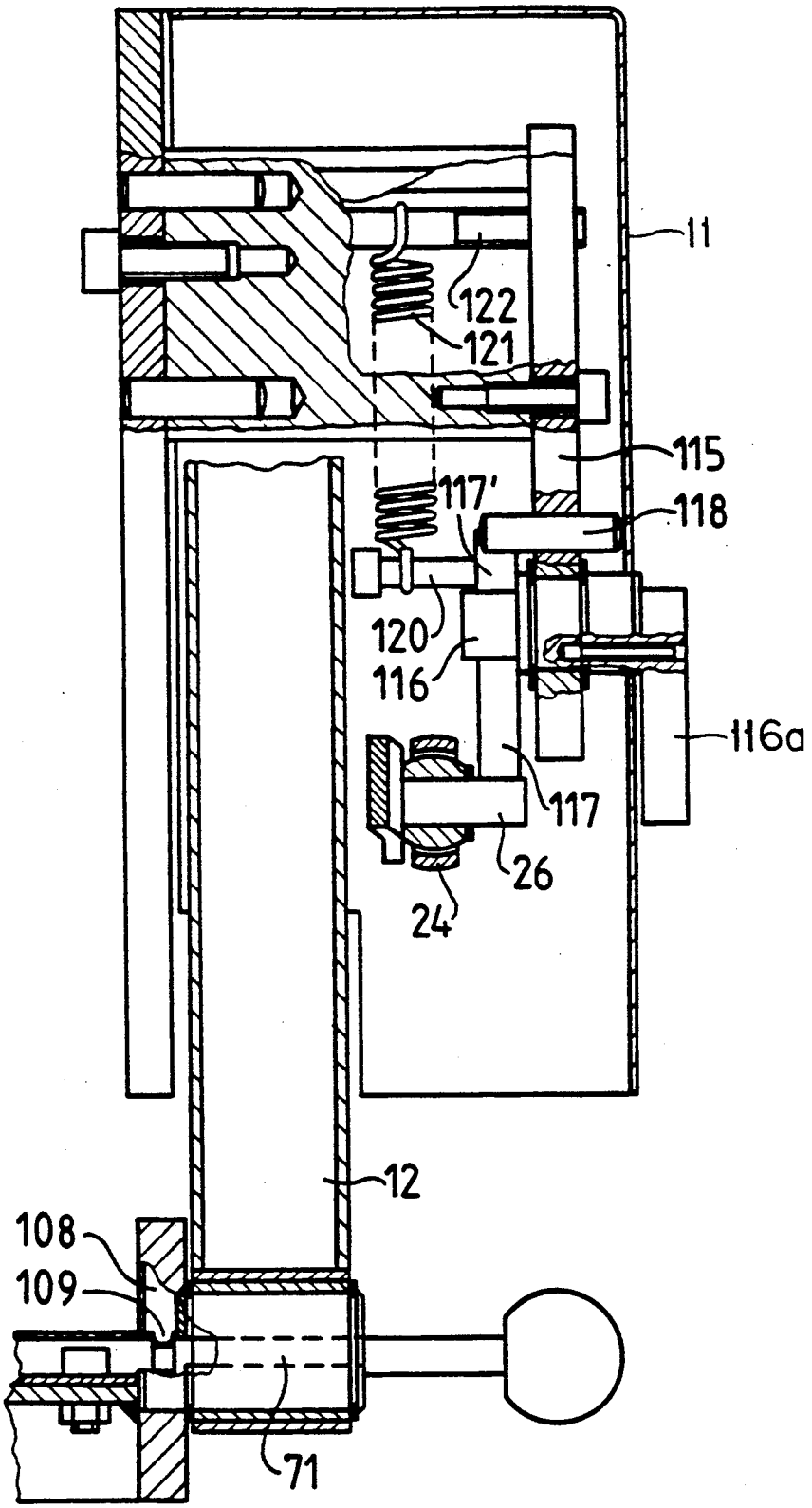
FIG. 7 is a sectional view taken along the line 7—7 in FIG. 1.

The slider 83 is connected to a flexible connector 96 such as a cable, belt or chain which extends in a loop 96' over deviation rollers 97, 98, 99 and 100 and is connected by a screw 101 to the front side of the change sheet 14. The cable 96 extends through the hole 93 in the drawing-in rod 71. The front slider 80 is connected by means of a cable 102 to a pin 103 fixed on the base plate 65, so the front slider 80 permanently assumes the fixed position shown. All of the sliders 80–83 are connected with each other by means of flexible pieces of belt 104, 105 and 106, the broader side of which is oriented perpendicular to the base plate 65. When the rod 71 is pushed into the change sheet, the connectors 96, 106 pull the sliders away from one another. When pulled out, the rod pulls connector 95 to bring the sliders together to one side of the change sheet. The pieces of belt 106 are sufficiently long so that, when the drawing-in rod is pushed into the change sheet, the thread guide elements 80', 81', 82' and 83' are each situated in line with the thread guide slot of the appropriate tube on the winding mandrel of the winding package revolver of the winding machine. In this pushed-in position, the drawing-in rod 71 is releasably locked by means of a spring-loaded pin 108 which snaps into position in a groove 109 in the rod (FIG. 7).

The drawing-in mechanism of the thread changing system operates as follows; for hanging the threads from the packages in the thread guide elements 80', 81', 82', 83' the drawing-in rod 71 of the change sheet 14 is drawn outwards. Consequently, the section 92' of the connector 92 becomes longer and the section 92 thereof becomes shorter, so that the rear slider 83 is drawn forwards, thereby pushing the two sliders 82 and 81 forwards (i.e., to the right in FIG. 6). When the drawing-in rod 71 is completely drawn out, all three sliders lie against the front slider 80. All sliders are now collected at the front end 40 of the change sheet 30, so that the thread guide elements 80', 81', 82', 83' are easily accessible for hanging the threads. If, after hanging the threads in the thread guide 14, the rod 71 is pushed back in the change sheet, then the slider 83 is drawn backwards, whereby the two sliders 82 and 81 are drawn rearwardly with the slider 83 until the belt pieces 106 and 105 are taut. The thread guide elements 80'–83' now are again situated in regular clearance from each other in the change sheet 14 and each are in line with the catcher slot of the appropriate tube.

When swinging the thread changing device 14 to a thread changing position **14*b*, it is necessary to precisely locate the device in that position. On the other hand, it is also necessary to enable the device 14 to be moved therepast to the thread drawing-in position 14*c*** during an initial threading-up of the apparatus. Accordingly, a limiting mechanism will now be described for enabling those goals to be met.

Figure 2:
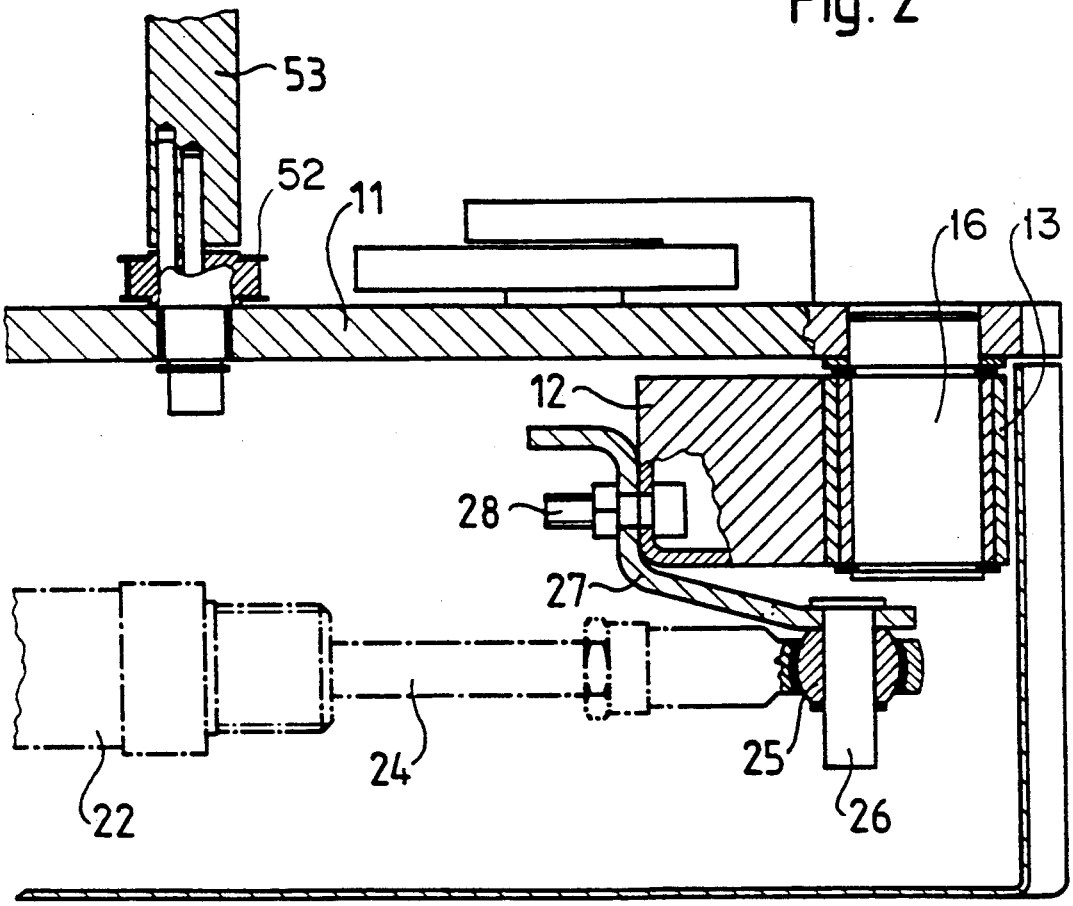
FIG. 2 is a longitudinal cross section taken along line 2—2 in FIG. 1.

A plate 115 (FIGS. 1, 7) is fastened with a clearance on the free side wall 11 of the sliding carriage 10. Arranged on the plate 115 is a pin 116 on which a rocker arm lever 117 pivots freely. Two stops 118 and 119 (FIG. 1) on the plate 115 serve for the limitation of the rotary movement of the rocker ar lever 117. The rotational planes of the rocker arm lever 117 lie parallel to the movement planes of the piston rod 24 of the servo-motor 22 (FIG. 2). One leg 117' of the rocker arm lever 117 is provided with a screw 120, on one end of which a tension spring 121 is fastened; the other end of the spring is fastened to a screw 122 on the plate 115. A manually actuable handle **116*a* is secured to the pin 116 to enable an operator to manually rotate the plate 117** to a position enabling an initial threading-up of the machine to take place, as will be hereinafter described in more detail.

The manner of operation of the rocker arm lever 117, which serves the purpose of limiting the swinging out of the change sheet 14 during the thread drawing-in step is described later.

Figure 8:
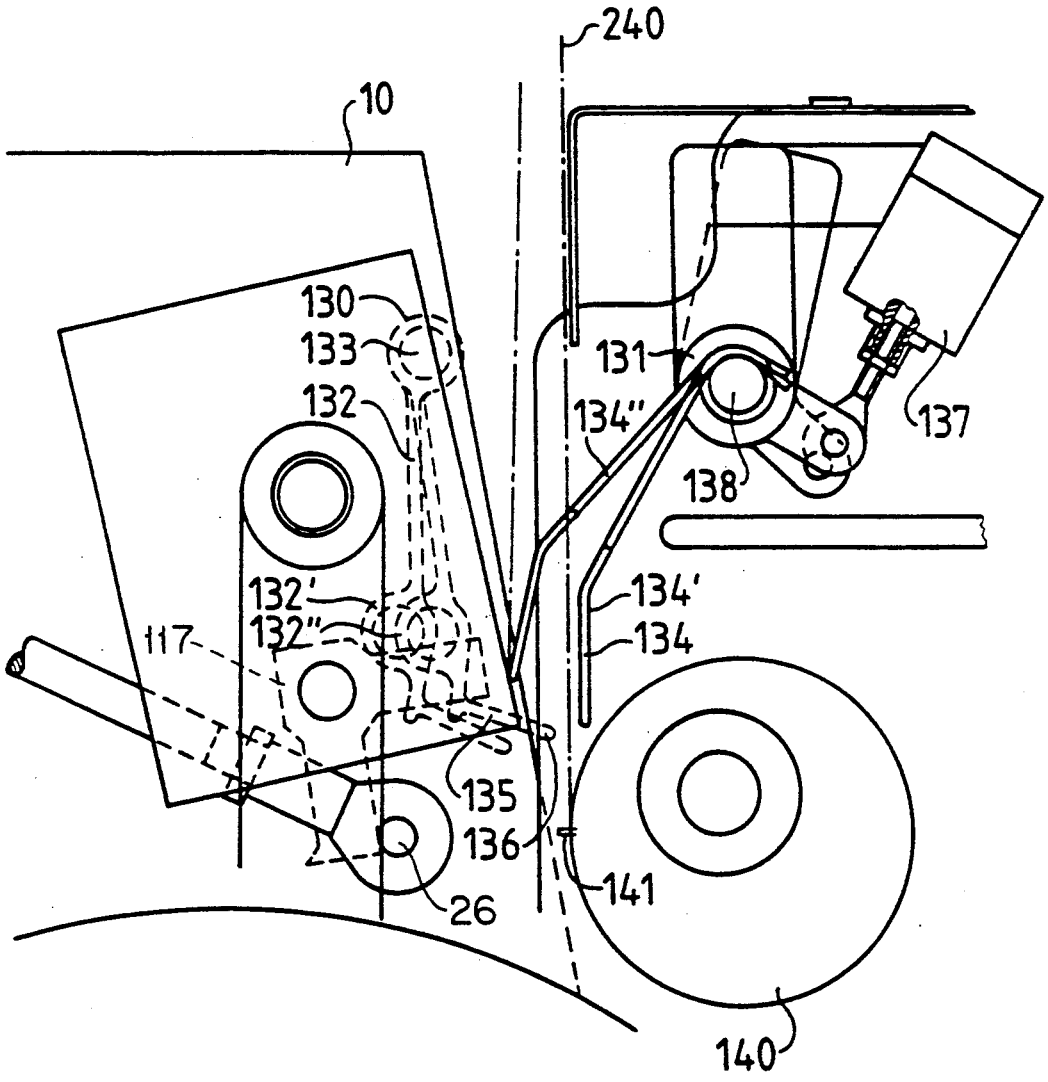
FIG. 8 is a partial sectional view in side elevation of the sliding carriage depicting a thread movement device and a thread deviation device.

FIG. 8 shows a conventional thread displacement device 130 and a conventional thread deflecting device 131 of the thread changing system of the winding machine. A slide sheet 132 of the thread displacement device 130 is rotated by means of a servo-motor (not shown) via a shaft 133 extending in the longitudinal direction through the sliding carriage 10, the slide sheet being rotated between an output position 132' and an operating position 132''. Furthermore, the slide plate 132 can also be slid in the axial direction on the shaft 133 by means of a servo-motor (not shown) and is provided with regularly spaced grooves 136 on its free angled end 135 which faces a lifting plate 134 of the thread deflecting device 131. The lifting plate 134 is swiveled by means of a servo-motor 137 about the axis of a shaft 138 extending through the sliding carriage 10 in a longitudinal direction, the plate 134 being swiveled between a rest position 134' and an operation position 134''. Furthermore, in FIG. 8 a conventional thread traversing device 140 can be seen which reciprocates a thread guide 141 in the longitudinal direction of the sliding carriage.

Figure 9A:
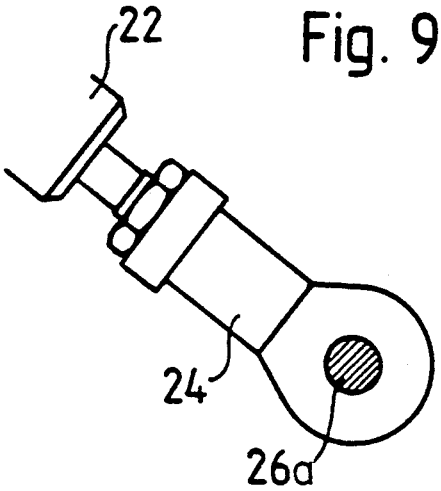
Figure 9B:
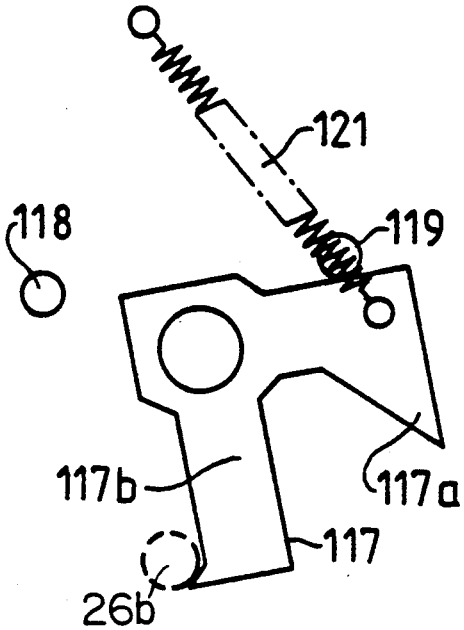
Figure 9B:
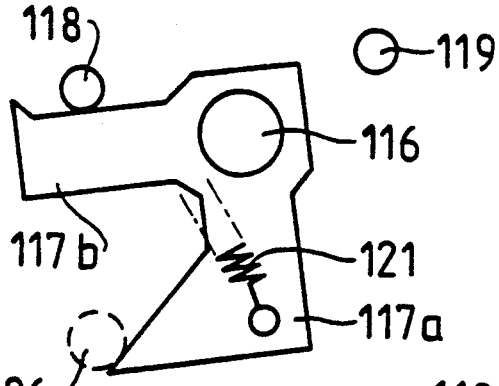

The operation of the limiting mechanism will now be explained. When initially threading up the winding machine, the piston rod 24 of the servo-motor is in a retracted position (see the solid lines of FIG. 9*a*); the change sheet 14 is thus located in the rest position **14*a* (FIG. 1) and the joint pin is in a rest position 26A** (FIG. 9*a*). The rocker arm lever 117 is located in the position shown in FIG. 9*a*, because its leg **117*a* is drawn by the tension spring 121 against the stop 119. The lever 117 is free to turn, because the joint pin is located in the solid line position 26*a*** of FIG. 9*a*. The rocker arm lever 117 is now manually turned clockwise by handle **116*a* against the tension of the spring 121** into the position according to FIG. 9*b*. As soon as the spring 121 has traveled to the left of the pin 116, it tips the rocker ar lever 117 and brings the leg **117*b* against the stop 118, so that it is fixed in this position. The servo-motor is now switched on causing the piston rod 24 to extend and swivel the change sheet 14 into the thread drawing-in position 14*c***.

Figure 9C:
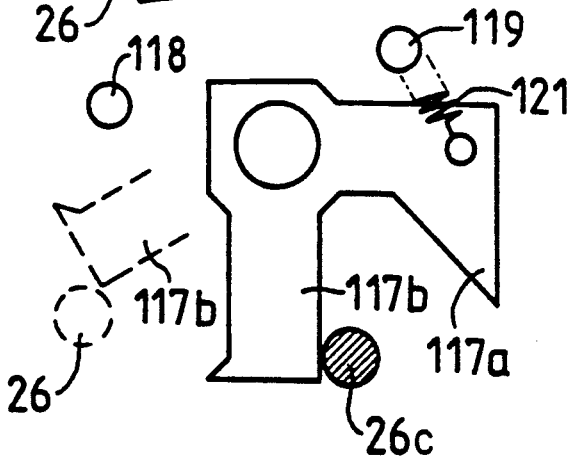

As soon as the joint pin 26 of the piston rod reaches the leg **117*a* of the rocker arm lever 117** by this movement (see FIG. 9*b*), it starts to turn the rocker arm lever 117 counterclockwise. Thereby, the joint pin 26 comes into position behind the leg **117*b* of the rocker arm lever 117. As soon as the tension spring 121 travels to the right of the pin 116, it turns the rocker arm lever 117 further counterclockwise and presses the leg 117*b* against the joint pin 26. The rocker arm lever 117** is now in the position shown in FIG. 9*c*. The piston rod 24 and the change sheet 14 are now fixed in this thread drawing-in position (position **14*c* in FIG. 1), wherein the joint pin is in a corresponding position 26*c*** (FIG. 9*c*). The change sheet 14 is completely swung out (down), so that it is easily accessible for drawing-in the thread in the thread guide. The drawing-in of the thread can now be started.

First of all, the drawing-in rod 71 of the change sheet 14 is drawn outwards, so that the thread guides 80', 81', 82', 83' are collected and accessible at the front end 40 of the change sheet 14. The drive motor of the traversing device 140 (FIG. 8) is switched on. The threads leaving the outlet of the machine are individually hung in the conventional thread guides by means of a conventional suction pipe. Thereupon, the drawing-in rod 71 is pushed back into the change sheet 14, so that the thread guides 80', 81', 82', 83' are displaced to be in line with the catcher slots of the empty tubes on the winding mandrel as previously described. Thereupon, the threads are laid and tightened in the conventional catcher slots of the empty tubes on the winding mandrel in the known interplay of the thread deflecting device 131 and the thread displacement device 130, with or without axial displacement of the mandrel.

The servo-motor is now switched over and starts to retract the piston rod 24. Accordingly, the joint pin 26 presses against the leg 117*b* and turns the rocker arm lever 117 clockwise against the tension of the tension spring 121. After the leg 117*b* has been turned through a predetermined angle shown in broken lines in FIG. 9*c*, the joint pin 26 slides under this leg and releases itself from the rocker arm lever 117. The retraction of the piston rod 24 proceeds. The rocker arm lever 117 is turned back counterclockwise by the tension spring 121 until its leg 117*a* lies against the stop 119. The rocker arm lever 117 is now located in the position shown in FIG. 9*a*. The machine is now ready for operation and is switched on. The rocker arm lever 117 remains in this position during the operation of the machine.

When it becomes necessary to make a thread change during the operation of the machine, the change sheet 14, according to the programming of the servo-motor 22, is extended until the joint pin 26 abuts against the leg 117*b* of the rocker arm leg (see the broken lines of FIG. 9*a*). The change sheet 14 now occupies the thread change position designated with the reference number 14*b* in FIG. 1, whereby the joint pin occupies a corresponding position 26*b* (FIG. 9*a*). In this position, the well known interplay between the change sheet 14, the conventional thread deflecting device 131 and the conventional thread displacement device 130 takes place for changing the thread from the full package on to the empty tube.

The embodiment according to FIGS. 10–14 involves a thread changing device, wherein the threading device is arranged separately from a change sheet 194 (see FIG. 11). This changing device requires no axial mandrel displacement during the thread change. FIG. 12 shows a thread drawing in device 150 in a view from the front (FIG. 12). The device 150 comprises a longitudinal carrier 151 which extends over the length of a sliding carriage 152 (FIG. 11) of the winding machine and carries an endless toothed belt 161. The belt has mounted thereon eight thread guides 153, 154, 155, 156, 157, 158, 159 and 160 (FIG. 13 and 18). The toothed belt 161 wraps around two gear wheels 162 and 163, which are respectively fastened on ends 164, 165 of the longitudinal carrier 151. The toothed belt 161 is surrounded by a protective tube 167. The longitudinal carrier 151 is connected to an arm 151*a* which swivels on a pin 170 on the front side wall 168 (FIG. 11) of the changer device 169. The pin is fastened on an arm 171 (FIG. 12) of the changer device 169. On a rear end of the changer device 169, facing towards the machine casing side wall, the opposite end of the longitudinal carrier 151 is connected to an arm 151*b* which swivels on a pin 172 (FIG. 10), which pin 172 is fastened on an arm 173 of the changer device 169. The gear wheel 162 is driven by a hand crank 177 by means of a bevel gear drive 174 which includes bevel gears 175 and 176. The toothed belt 161 with the thread guides 153–160 is set in axial motion with the turning of the crank 177. Movement of the toothed belt 161 can be terminated in either of two positions by means of a locking device 178, so that a group of four thread guides is located at either one or the other side of the longitudinal carrier 151. One group of four thread guides 157 to 160 is then located on one changing device 179 on the opposite side of the longitudinal carrier 151, the other group of four thread guides 153 to 156 is on the rear side thereof. The locking device 178, which can be of any suitable configuration, preferably comprises two blocks 180 and 181 (FIGS. 13, 18) which are fastened on two diametrically opposite locations on the toothed belt 161, and a pin 182 (FIG. 12) which can be turned by means of a rotary knob 183 into the path of the blocks 180 or 181, so that movement of the toothed belt 161 will be stopped thereby. The thread drawing-in device 150 can be fixed in the starting position 150*a* (FIG. 11) by means of a spring-biased fixing bolt 185 having a hand grip 186, or fixed in the thread changing position 150*b*. The thread drawing-in device 150 is locate in the thread drawing-in position 150*b* opposite to the thread changing device 179, according to FIG. 11.

The thread changing device 179, as described in connection with FIG. 1, is hung on the sliding carriage 152 of the winding machine by two carrying levers 190 and 191 and by one (not shown) curved carrying lever. The change sheet or thread guide member 194 of the changing device 179 obtains its swiveling movement from a linear servo-motor in the same way as in FIG. 1. The change sheet 194 itself (FIG. 13) comprises a base plate 196 and a cover plate 197, which are screwed together to leave therebetween a hollow space. In the hollow space, four thread guide arrangements 200, 201, 202, and 203 are disposed at regular intervals from each other, of which only the arrangement 201 is completely visible in FIG. 13. That arrangements 201 includes a slider 205 with a retraction hook 206 (see FIGS. 13, 14). The slider 205 is guided in a rectangular recess 207 running transversely to the longitudinal direction of the change sheet 194. The slider 205 is shown in the starting position 205', in which position the retraction hook 206 projects from the leading side 209 of the change sheet 194. The slider 205 is held in this position by a lever 210 which pivots on a pin 211 on the base plate 196 and is pressed by a compression spring 212 against the slider 205. The guide arrangement 201 also includes a Y-shaped recess 214 formed in the base plate 196 in the area of the slider 205, one leg 215 of which is curved and the other leg 216 of which runs perpendicularly to the direction of the base plate 196. Both legs 215 and 216 merge into a straight channel 217 which is arranged obliquely to the slider 205.

A linear servo-motor 221 with a piston rod 222 is fastened on the carrying lever 190 by means of a bracket 220 (FIG. 11). The piston rod is provided with a pin 224 on its free end and a flexible connector such as a cable 225 is guided over this pin. The cable 225, one end 225' of which is fastened to a screw 226 on the driven carrying lever 190, runs over two rollers 227 and 228 (FIG. 13) fastened on the change sheet 194 and enters the change sheet 194. Then the cable 225 runs over rollers 230 and 231 along the four withdrawal positions 200, 201 and 202 up to the last withdrawal position 203, where it is fastened on a slider 232 (FIG. 18). A section of the cable 234 is diverted from the cable 225 by means of a clamp 233 and is guided over the roller 231. The end of the section 234 is fastened in the slider 205 at the withdrawal position 201. In the same way, other sections of the cable are diverted at the withdrawal positions 200 and 201, which, in each case, are conveyed to the appropriate slider and are fastened there.

When the servo-motor 221 is switched on, the piston rod 222 presses the cable 225 with its pin 224 to form a loop 236 of the cable 235, so that the cable length is correspondingly shortened. As a result, the slide 205 is drawn into the change sheet 194 carrying along with it the appropriate thread guide 206 against the tension of the tension spring 212. When the servo-motor 221 is switched off, the tension spring 212 pushes the slider 205 back into its starting position. The same applies to the movement of the other sliders with the appropriate thread guides; they are moved simultaneously with the slider 205.

The thread drawing-in device and the thread changing device operate as follows. Before initially threading-up the machine, the starting position of the winding machine is such that the servo-motor 195 is switched off and the change sheet 194 located in the starting position. The servo-motor 221 is likewise switched off, so that the loop 236 in the cable 225 is small. The thread drawing-in device 150 is located in the swung back position 150*a* below the changing device 169. To thread-up the winding machine for operation, the fixing bolt 185 is retracted, allowing the thread drawing-in device 150 to be swiveled clockwise downwards into the working position 150*b*. The driving motor of the changing device is switched on. The locking device 178 of the thread drawing-in device is unlocked by turning the knob 183. The threads emerging from the outlet of the winding machine are hung one after the other on a thread guide of the toothed belt 161, e.g., a thread 240 on the thread guide 159 is entered into the sliding carriage 152 by turning the crank 177. The thread drawing-in device is locked again immediately after all of the thread guides have been entered. The toothed belt 161 stops when the second block 181 on the toothed belt 161 reaches the pin 182 of the locking device. The threads are then located in line with the catcher slots of the empty tubes on the winding mandrel of the package revolver of the winding machine.

The servo-motor 195 is now switched on to swivel the change sheet 194 into the position 194*a*. There is now a retraction hook 240, 241, 242, 243 of the change sheet located opposite to a respective thread guide 160, 159, 158, 157 of the thread drawing-in device (FIG. 13). Upon a subsequent swiveling back of the change sheet 194 by the servo-motor 195 to the starting position, the retraction hooks take over the threads from the thread guides 157–160. The machine is now ready for operation and is switched on.

To make thread changes during the subsequent operation of the winding machine when the winding mandrel 245 (FIG. 14) carries a package which is nearly fully wound, the package revolver is turned so that the winding mandrels 245 and 247 move through an angle of 180°, whereby the thread 240 continues to be wound on the full package 246 and forms a ridge 248 there. After turning the package revolver, the change sheet 194 is swiveled (according to the pre-set program) by the servo-motor 195 into the position 194*a*. At the same time, the lifting plate 134 (FIG. 8) has been rotated to transfer the thread 24 to the slide sheet 132. As soon as the thread reaches the groove 136 in the slide plate 132, it is caught there and thereby lifted from the thread guide 141 of the traverse device 140. The slide plate 132 now slides the thread 240 axially in the direction of the catcher slot 250 of the empty tube 249 on the winding mandrel 247. The thread in this position is designated 240'. The servo-motor 221 is now switched on, which draws the slider 205 against the tension of the spring 212 more deeply into the change sheet 194 and brings it into the position 205*a*. The retraction hook 205 thereby draws the thread 240' along with it. As the thread rubs over the lower side 196' of the base plate 196, it slides along axially to the right of the curved leg 215 of the recess 214. The leg 215 is curved in such a way that the thread 240' is diverted away over the catcher slot 250 of the empty tube 249. As soon as the thread has reached the straight, inclined channel 217 of the recess 214, it is then drawn back axially to the left. It is ensured through this reciprocation over the catcher slot 248 that the thread is surely caught there. The thread 240', which continues to run onto the full package through the channel 217 and the drawing-in hooks 205, forms the ridge 248, until it breaks due to the tension in the thread. The servo-motor 221 is switched over, so that the cable 225 is tightened again and the slider 205, together with the catcher hook 206, is returned to the starting position under the influence of the spring 212 and the lever 210. Thereupon, the servo-motor is switched over, which returns the change sheet 194 into the starting position.

FIGS. 15, 16 and 17 show schematically a front view of the casing 300 of the winding machine, a sliding carriage 310, a change sheet or thread guide member 314 with carrying levers 312 and 312, a tachometer shaft 305, a traverse device 340 and two package mandrels 345, 347. FIG. 15 shows the change sheet 314 in a starting or rest position. FIG. 16 shows the change sheet 314 in a drawing-in position, which is suitable for taking over the thread led past the traverse device 340. Finally, FIG. 17 shows the change sheet 314 in a suitable delivery position for the package change. The movement of the change sheet 314 between these locations can be effected through the movement systems according to FIGS. 1 to 9 or according to FIGS. 10 to 14.

Although the invention has been described in connection with preferred embodiments thereof, it will be appreciated by those skilled in the art that additions, modifications, substitutions, and deletions not specifically described may be made without departing from the spirit and scope of the invention as defined in the appended claims.

What is claimed is:

1. In a winding machine for winding a thread upon a package, wherein a thread change mechanism is provided for positioning at least one thread relative to the package, said thread change mechanism including a thread guide member having first and second longitudinally spaced ends, means including two swingable levers mounting said thread guide member for swinging movement relative to a housing of said machine, one end of each lever being pivotably mounted to said housing, and another end of each lever being attached to said thread guide member adjacent said first end thereof and constituting a swinging end of the respective lever, said first end of said thread guide member being supported by said swinging ends of said levers for swinging movement toward and away from the package, a servo-motor operably connected to one of said levers for swinging said thread guide member to a thread changing position, and a power transmission mechanism operably interconnecting said first and second ends for positively transmitting a swinging motion of said first end to said second end to effect synchronous swinging movement of said first and second ends.

2. Apparatus according to claim 1, wherein said swinging lever ends are pivotably connected to said first end of said guide member.

3. Apparatus according to claim 1, wherein said power transmission member comprises a third lever operably connected to said guide member adjacent said first end thereof for displacement in response to swinging movement of said guide member, a fourth lever operably connected to said guide member adjacent said second end thereof, and interconnecting means separate from said thread guide member interconnecting said third and fourth levers for transmitting said displacement of said third lever to said fourth lever.

4. Apparatus according to claim 3, wherein said interconnecting means comprises a first wheel mounted for rotation about an axis, an end of said third lever being pivotably mounted to said first wheel for rotating the latter, a second wheel mounted for rotation about said axis, means including a connecting shaft interconnecting said first and second wheels for common rotation, opposing ends of said fourth lever being pivotably mounted to said second wheel; and said second end of said guide member, respectively.

5. Apparatus according to claim 4, wherein said interconnecting means further includes a first belt operably interconnecting said first wheel and said connecting shaft, and a second belt operably interconnecting said second wheel with said connecting shaft.

6. Apparatus according to claim 4 including first and second elements freely rotatable about a common axis extending parallel to said first-named axis, said first and second elements including holes through which respective ones of said third and fourth levers extend perpendicularly relative to said common axis for free linear sliding movement relative to said elements.

7. Apparatus according to claim 1, wherein at least one thread guide element is mounted on said guide member for longitudinal movement therealong, a rod operably connected to said thread guide element and being longitudinally movable into and out of said thread guide member for longitudinally displacing said thread guide element.

8. Apparatus according to claim 7, wherein said rod is of shorter length than said guide member, there being a plurality of said guide elements each comprising a slider slidable lengthwise along said guide member, one of said sliders being permanently located at one end of said guide member, the remaining sliders being movable lengthwise along said guide member and being interconnected by first flexible connector means to each other and to said one slider, said rod being operably connected by second flexible connector means to an end-most one of said remaining sliders which is situated remotely from said one slider, whereby longitudinal movement of said rod causes said remaining sliders to be moved selectively toward and away from said one slider.

9. Apparatus according to claim 8, wherein said rod includes a hole, said second flexible connector means passing through said hole.

10. Apparatus according to claim 1 including a thread drawing-in mechanism mounted on said thread guide member.

11. Apparatus according to claim 1 including a thread drawing-in device positioned in spaced relation to said thread guide member and containing a plurality of thread guides movable in the longitudinal direction.

12. Apparatus according to claim 11, wherein said drawing-in device includes an endless conveyor belt carrying said thread guides.

13. Apparatus according to claim 12, wherein said conveyor belt extends around two pulleys so as to be divided into parallel front and rear conveyor belt sections, there being two sets of said thread guides, each set including a thread guide for each thread position of the machine, said conveyor belt being movable to longitudinally displace said sets of thread guides whereby said sets are positionable on respective ones of said conveyor belt sections.

14. Apparatus according to claim 13 including locking means engageable with said conveyor belt for positioning a selected one of said sets of thread guides relative to catcher slots on empty package tubes.

15. Apparatus according to claim 13, wherein said thread drawing-in device is movable between a rest position remote from said thread guide member and a working position adjacent said thread guide member.

16. Apparatus according to claim 1, wherein said guide member carries a plurality of sliders movable transversely relative to a longitudinal dimension of said guide member, each slider carrying a thread guide, flexible connector means operably connected to said sliders for moving said sliders in said transverse direction.

17. Apparatus according to claim 1, wherein said thread guide member is swingable from a rest position to either of two working positions, and limiting means is provided for positioning said thread guide member in one of said working positions while being displaceable to permit said guide member to travel past said one working position to the other working position.

18. Apparatus according to claim 17, wherein said servo-motor comprises an extensible-retractable rod, said limitation means comprising a pivotable plate having first and second legs selectively positionable in a path of travel of said rod, said plate being spring-biased to a first position wherein said first leg abuts a first fixed stop and said second leg is positioned to abut said rod to define said one working position of said guide members, said plate being pivotable to a second position wherein said spring biases said second leg against a second fixed stop and permits said rod to displace said plate against the bias of said spring while traveling to said other working position.

19. In a winding machine for winding a thread upon a package wherein a thread change mechanism is provided for positioning at least one thread relative to the package, a package revolver on which two packages are mounted, said revolver being rotatable when one package is full in order to position an empty package for receiving thread and to position the full package for removal from the machine, said thread change mechanism including a thread guide member, and means for moving said thread guide member between three positions defining a rest position, a thread changing position for transferring thread from a full package to an empty package, and a thread drawing-in position for enabling thread to be laced onto said thread guide member, said thread changing position being situated between said rest position and said thread drawing-in position, and said thread guide member being arranged to move through and beyond said thread changing position to reach said thread drawing-in position.

* * * * *